US007954257B2

(12) United States Patent
Banik

(10) Patent No.: US 7,954,257 B2
(45) Date of Patent: Jun. 7, 2011

(54) FOOTWEAR CONSTRUCTION AND RELATED METHOD OF MANUFACTURE

(75) Inventor: Gary J. Banik, Boulder, CO (US)

(73) Assignee: Wolverine World Wide, Inc., Rockford, MI (US)

( * ) Notice: Subject to any disclaimer, the term of this patent is extended or adjusted under 35 U.S.C. 154(b) by 881 days.

(21) Appl. No.: 11/936,232

(22) Filed: Nov. 7, 2007

(65) Prior Publication Data

US 2009/0113757 A1 May 7, 2009

(51) Int. Cl.
*A43B 13/18* (2006.01)
*A43B 23/08* (2006.01)

(52) U.S. Cl. ..... 36/28; 36/35 R; 36/69; 36/59 R

(58) Field of Classification Search ..... 36/28, 35 R, 36/69, 68, 30 R, 59 A
See application file for complete search history.

(56) References Cited

U.S. PATENT DOCUMENTS

| | | | | |
|---|---|---|---|---|
| 3,256,621 | A | 6/1966 | Linton | |
| 4,616,431 | A * | 10/1986 | Dassler | 36/28 |
| 4,733,483 | A | 3/1988 | Lin | |
| 4,845,863 | A | 7/1989 | Yung-Mao | |
| 4,887,367 | A | 12/1989 | Mackness et al. | |
| 4,897,936 | A * | 2/1990 | Fuerst | 36/30 A |
| 4,918,838 | A * | 4/1990 | Chang | 36/28 |
| 5,077,915 | A | 1/1992 | Gross | |
| 5,086,574 | A * | 2/1992 | Bacchiocchi | 36/35 R |
| 5,092,060 | A * | 3/1992 | Frachey et al. | 36/29 |
| 5,233,767 | A | 8/1993 | Kramer | |
| 5,367,791 | A * | 11/1994 | Gross et al. | 36/31 |
| 5,799,417 | A | 9/1998 | Burke et al. | |
| 5,815,949 | A * | 10/1998 | Sessa | 36/3 B |
| 5,933,982 | A | 8/1999 | Chen | |
| 5,970,628 | A | 10/1999 | Meschan | |
| 6,023,859 | A | 2/2000 | Burke et al. | |
| 6,226,896 | B1 | 5/2001 | Friton | |
| 6,497,057 | B1 | 12/2002 | Lee et al. | |
| 6,802,138 | B2 | 10/2004 | McManus et al. | |

(Continued)

FOREIGN PATENT DOCUMENTS

DE 20320091 5/2005

(Continued)

OTHER PUBLICATIONS

European Search Report, Mar. 12, 2009.

(Continued)

*Primary Examiner* — Ted Kavanaugh
(74) *Attorney, Agent, or Firm* — Warner Norcross & Judd LLP

(57) ABSTRACT

A footwear construction including a sole component and shock pods that absorb impact forces caused by activity. The sole component can be a midsole defining at least one shock pod hole that reduces in dimension from a midsole lower surface toward a midsole upper surface. A shock pod can be joined with the midsole, and extend from the lower surface toward the upper surface. The midsole can be constructed from a harder material than the material from which the shock pod is constructed. A outsole can be joined with the midsole so that a lower portion of the shock pod, for example a traction lug, extends through the outsole to form a ground contacting surface. The shock pod and the shock pod hole can be of corresponding frustoconical shapes. A method is provided including joining a shock pod with a midsole, and joining an outsole with the midsole.

17 Claims, 5 Drawing Sheets

U.S. PATENT DOCUMENTS 7,168,187 B2 1/2007 Robbins

FOREIGN PATENT DOCUMENTS

| | | |
|---|---|---|
| EP | 1417901 | 5/2004 |
| EP | 1714571 | 10/2006 |
| WO | 0101806 | 1/2001 |

OTHER PUBLICATIONS

Canadian Office Action in Canadian Application 2,642,356 dated Oct. 7, 2010.

Australian Office Action in Australian Application 2008237540 dated Apr. 13, 2010.

* cited by examiner

FOOTWEAR CONSTRUCTION AND RELATED METHOD OF MANUFACTURE

BACKGROUND OF THE INVENTION

The present invention relates to footwear, and more particularly to a sole construction for footwear.

In a variety of activities, the primary function of footwear is to protect and support the wearer's foot. Much of the support and protection afforded by footwear is attributable to the design and configuration of the sole. The sole protects the foot by dispersing the sometimes significant forces caused by running, jumping, training, and even walking. The sole also provides cushioning that absorbs impact and protects the wearer (e.g., their feet, ankles and knees) from the stress associated with strenuous and even day-to-day activities. At the same time, the sole plays a role in helping support the foot in its proper shape to reduce the risk of the foot becoming fatigued over time.

The objectives of providing adequate cushioning and providing support often compete with one another. A highly cushioned sole, designed to efficiently absorb significant impact forces, may not provide sufficient foot support, which may lead to premature foot fatigue. On the other hand, an overly firm sole, designed to provide lateral support and general stability for the foot, may feel uncomfortable, and may not provide the cushioning needed to protect the wearer against potential damage or injury associated with repeated ground impact. Accordingly, there is an ongoing interest in developing footwear sole constructions that provide an appropriate balance between cushioning and support.

SUMMARY OF THE INVENTION

The present invention provides footwear having a sole construction including at least one shock pod that efficiently cushions a wearer's foot from impact forces caused by activity.

In one embodiment, the sole component can be a midsole constructed from a harder, supportive material, while the shock pod can be constructed from a softer, cushioning material. Optionally, the shock pod is positioned at one or more locations associated with the impact zones of a foot, for example, the heel and/or forefoot.

In another embodiment, the midsole can define at least one hole extending substantially through the midsole, from a lower surface toward an upper surface. A shock pod can be positioned in and substantially fill the hole so that the pod also extends from the lower surface of the midsole, through to the upper surface of the midsole. The shock pod can be secured within the hole with cement, or can float freely within the hole, or can be molded directly with the midsole as desired.

In another embodiment, the hole defined by the midsole can have a downwardly opening taper, so that the cross section of the hole increases progressing from the upper surface of the midsole to the lower surface of the midsole. Optionally, the pod also can have a corresponding shape to nest within the hole, for example, the pod can have an upwardly thinning taper. One example of a hole and shock pod shape in this embodiment includes a hole having a downwardly opening frustoconical shape, and a shock pod having a corresponding, upwardly thinning frustoconical shape.

In yet another embodiment, the sole construction can include an outsole adjacent the midsole. Optionally, the outsole can define holes. The shock pod can include a lower portion having traction lugs. These lugs can extend through the outsole holes to form a ground contacting surface of the shock pod.

In a further embodiment, the shock pods can include an upper surface that defines a concentric groove to aid in cushioning.

In yet a further embodiment, the sole construction can include a heel counter joined with lateral and medial sides of the midsole, and wrapping around the heel of a wearer. The heel counter can assist in centering the heel and guiding impact of the foot with a heel shock pod.

The present invention also provides a method of manufacturing a sole construction including: providing a midsole including an upper surface, a lower surface, and defining at least one shock pod hole that reduces in dimension as the hole extends from the lower surface toward the upper surface; joining a shock pod with the midsole so that the shock pod extends from at least the lower surface toward the upper surface of the midsole; and optionally joining an outsole with the midsole so that a lower portion of the shock pod extends through the outsole to form a ground contacting surface; and joining an upper with the midsole.

The present invention provides footwear having a sole construction that provides cushioning, as well as support and stability, to a wearer's foot. With its efficient cushioning, the construction provides excellent shock absorption. The configuration of the midsole holes and the shock pods mechanically lock the pods with the midsole, and help transfer impact force from the ground into the midsole rather than directly to the wearer's foot. The construction also can provide stability because the midsole can isolate and contain the impact deformation of the shock pods as they cushion the foot from impact. When included, the shock pod traction lugs can further diffuse ground impact force. The present invention provides footwear having superior impact absorption and combined structural support for the foot of a wearer.

These and other objects, advantages, and features of the invention will be readily understood and appreciated by reference to the detailed description of the current embodiment and the drawings.

DESCRIPTION OF THE CURRENT EMBODIMENT

I. Construction

Figure 1:
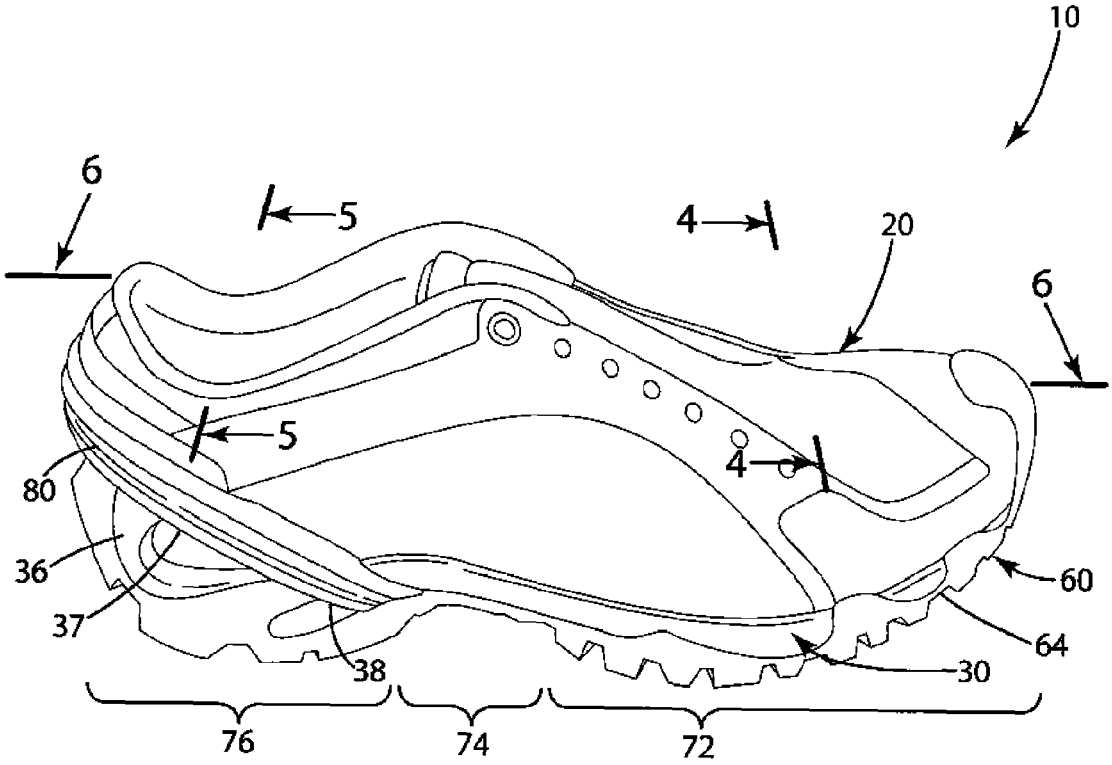
FIG. 1 is a perspective view of footwear of a current embodiment.

A footwear construction of the present invention as shown in FIG. 1 and generally designated 10. For purposes of this disclosure, the footwear construction is described in connection with an athletic shoe, however, it is well suited for use with essentially any type of footwear, such as boots, casual shoes, sandals and the like.

The shoe 10 can include an upper 20 and a sole component, such as a midsole 30. The midsole 30 can define midsole holes 40 in one or more regions of the foot, for example, in the forefoot, near the ball of the foot, and/or the heel region of the footwear. Positioned within the midsole holes, also referred to as shock pod holes 40 are the shock pods 50. The shock pods can include one or more lugs 58. An outsole 60 can be joined with the midsole. The outsole can include one or more outsole holes 68, and the shock pod lugs 58 can extend through the outsole holes to define a ground contacting surface.

As used herein, the term "arch region" generally refers to the portion of the footwear corresponding to the arch of the wearer's foot; the term "footwear region" refers generally to the portion of the footwear forward of the arch region corresponding to the forefoot, (e.g. the ball and/or toes) of a wearer's foot; and the term "heel region" refers generally to that portion of the footwear rearward of the arch region corresponding to the heel of the wearer's foot. The forefoot region 72, arch region 74 and heel region 76 are generally identified in FIG. 1, however, it is to be understood that the delineation of these regions may vary depending on the configuration of the footwear.

Figure 2:
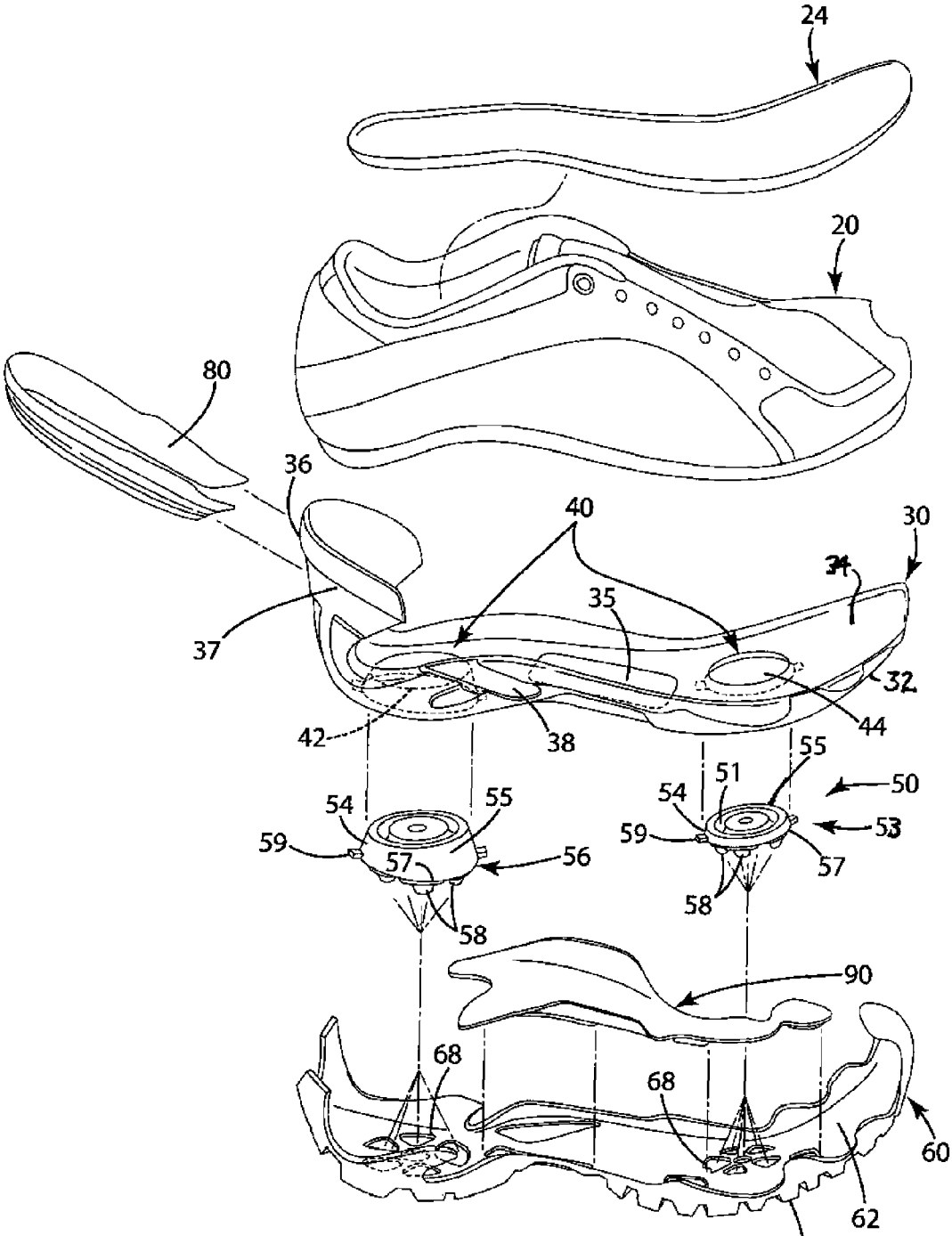
FIG. 2 is a top exploded perspective view of the footwear.
Figure 3:
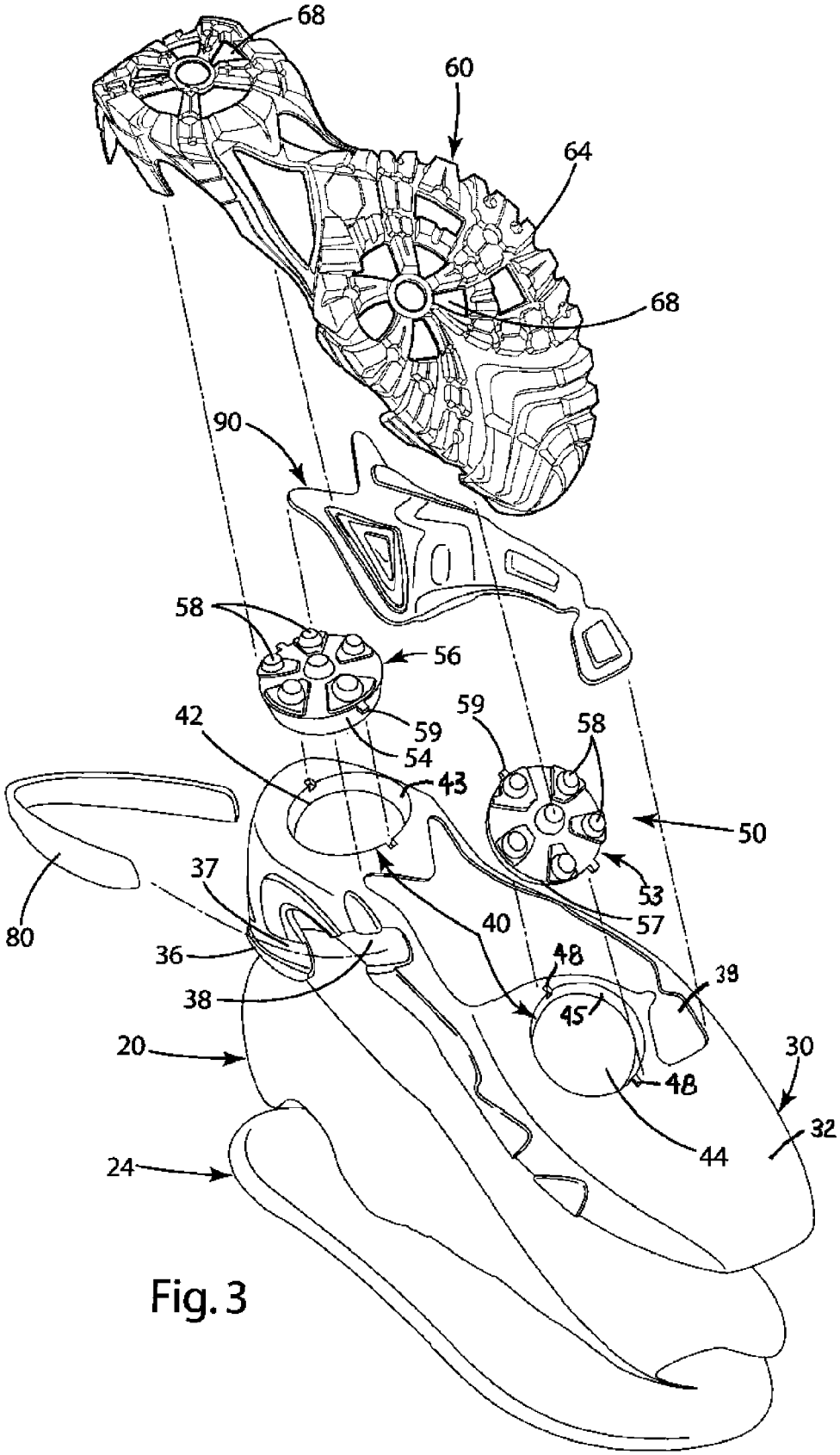
FIG. 3 is a bottom exploded perspective view of the components of the footwear.
Figure 4:
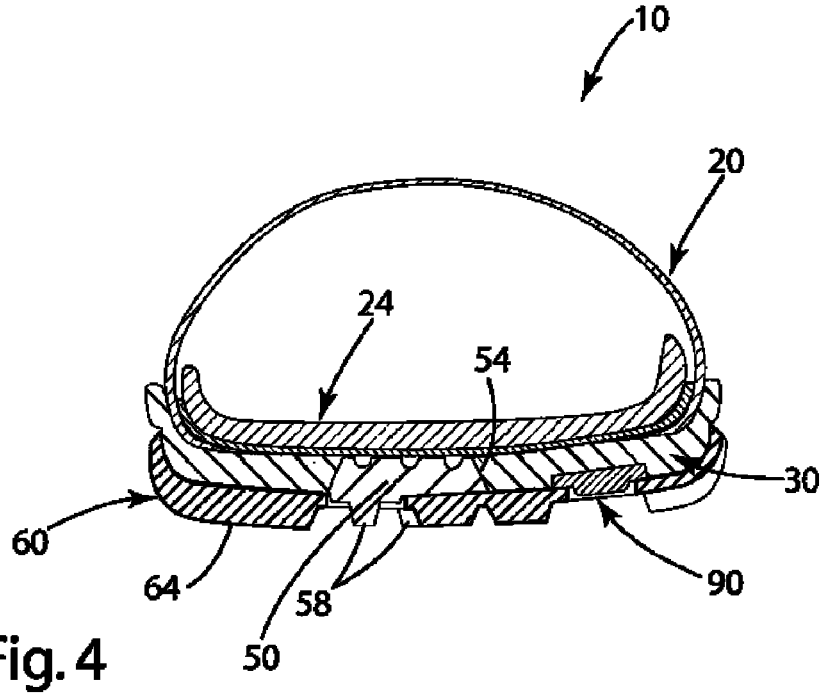
FIG. 4 is a sectional view of the footwear taken along line 4-4 of FIG. 1.
Figure 5:
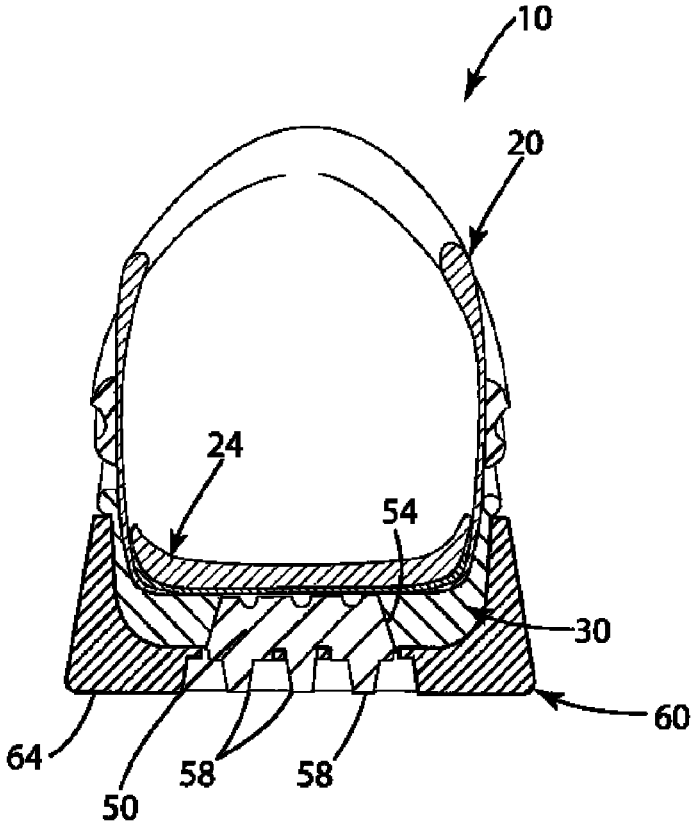
FIG. 5 is a sectional view of the footwear taken along line 5-5 of FIG. 1.

The upper 20 can be manufactured from conventional materials, for example, leather, mesh, canvas, nylon, polymeric materials, rubber or other sufficiently durable material according to conventional methods. For example, the upper can include a conventional Stroble construction, a lasted construction, or stitch-and-turn construction. In the illustrated embodiment, the upper 20 is configured, that is, sized and shaped, to accommodate an internal footbed 24 or sock liner. The internal footbed can optionally extend from heel to toe and/or from one side of the shoe to the other as desired. Optionally, the upper 20 can be closed along all or a portion of its bottom. As shown in FIGS. 2-3, the upper 20 is further manufactured for use with an external midsole, that is, a midsole 30 disposed outside of and beneath the upper 20. Alternatively, the upper 20 can be manufactured for use with an internal midsole, that is, a midsole disposed at least partially within the upper.

The footbed 24 can be positioned in the upper 20. The footbed can be constructed from ethylvinyl acetate (EVA) foam, or any other suitable cushioning material. The rigidity and the flexibility of the EVA foam can be varied as desired. The footbed 24 can be secured to the bottom of the upper and/or the midsole as desired to ensure that it does not move within the upper.

The outsole 60 is manufactured from a material suitable for providing a durable and non-slip wear surface. The design and configuration of the outsole 60 will vary from application to application as desired. In the illustrated embodiment, the outsole 60 is a polymeric material selected from a variety of outsole materials having a relatively high durometer, such as natural or synthetic rubber. The outsole 60 includes an upper surface 62 to which the lower surface 32 of the midsole and/or optionally a lower portion of the upper is joined.

The bottom of the outsole 60 includes a lower surface 64 that forms the wearing surface of the outsole 60 and that is contoured to the desired tread pattern. The outer surface 64 can be textured to improve the traction and aesthetic appeal of the shoe. As shown, the outsole 60 is substantially coextensive with the outer boundary of the upper 20. As shown in FIGS. 2-3, the outsole can define at least one or more outsole holes, such as lug holes 68. The outsole holes 68 can be aligned with optional protrusions or lugs 58 formed on the lower portion 57 of the shock pod 50. The protrusions or lugs 58 can be of sufficient depth so that they extend at least partially into and/or through the outsole holes 68 to form a ground-contacting surface as described below. The outsole 60 can be secured to the midsole 30 in any conventional manner, for example, with cement or adhesives or, as desired, and/or direct attached to this component.

With reference to FIGS. 1-3 and 6, the midsole 30 defines at least one midsole hole, also referred to herein as shock pod hole 40. As shown in FIG. 3, the first shock pod hole 42 is defined generally in the center of the heel region 76. Another optional shock pod hole 44 is positioned in the forefoot region 72, aligned substantially with the ball of a wearer's foot. In general, the shock pod holes 40 extend from the lower surface 32 of the midsole toward the upper surface 34 of the midsole. As shown, the holes extend completely through the midsole; however, as desired, the holes can extend only partially through the midsole, forming a recess. The midsole holes 40 are constructed and bounded so that they have a downwardly opening tapered configuration. In such a configuration, the side walls 43 and 45 can be curved and/or angled so that the uppermost portion of the hole is smaller than the lowermost portion of the hole. As shown, the general cross section of the midsole holes is circular, however, other shapes, such as triangular, elliptical, square, octagonal or any other geometric shape is suitable. In the embodiment shown in FIGS. 2 and 3, the holes are configured in a downwardly opening frustoconical shape. Optionally, other downwardly opening shapes can be selected as desired, for example, the shape can be a truncated pyramidal configuration or the like.

The holes can also define optional indexing features 48, which as shown are located around a periphery of the midsole holes 40. These indexing features can be configured to interlock with corresponding features, such as tab 59, on the shock pods 50 described below.

The midsole can also be configured to include a shank 35, which can be constructed of any suitable material, for example, steel, plastic, nylon or other material, which can be secured or molded within the midsole in the arch region 74 of the footwear. The shank can extend and/or overlap with other regions of the footwear as desired.

The midsole can further include a heel wall 36. As shown, the heel wall 36 extends upwardly in the heel region of the midsole 75. The heel wall 36 can define a heel band recess 37, which is adapted to receive a portion of a supportive heel counter band 80. The midsole can further define additional heel band recesses 38 near the forward portion of the heel region 76 and/or in the arch region 74 of the midsole. The heel band recess 37 and additional recesses 38 can securely hold the heel counter band 80 in a predetermined location. Specifically, the heel counter band 80 can be cemented within the heel band recess 37 and additional recesses 38 to optionally provide additional structural integrity and optionally assist in centering the heel of a wearer over the heel shock pod 56.

The midsole can further define a support plate recess 39 in the arch region 74 and other regions of the footwear as desired to accommodate a structural support plate 90. This support plate recess 39 can optional partially surround at least a portion of the shock pods 50 at or near the lower surface 32 of the midsole 30. The support plate 90 itself can be constructed from a rigid to semi-rigid material, such as plastic, fiberglass or nylon as desired. This support plate 90 can extend from the heel region 76, through the arch region 74, and optionally into the forefoot region 72. The support plate can be of varying thicknesses depending upon the desired rigidity supplied to the midsole. Moreover, the support plate 90 can be configured so that it at least partially surrounds portions of the shock pods 50 and respective midsole holes 40.

The midsole can be constructed from ethylvinyl acetate (EVA), thermoplastic polyurethane or other sufficiently rigid and/or semi-rigid materials, which can be synthetic or natural. In the embodiment shown, the midsole is constructed from a material, such as EVA, having a durometer of approximately 45 to about 65 Asker C. The midsole can be "harder" than the material from which the shock pods 50 are constructed so that the shock pods provide zonal cushioning in the heel and/or on the ball of the foot as discussed in further detail below.

Figure 6:
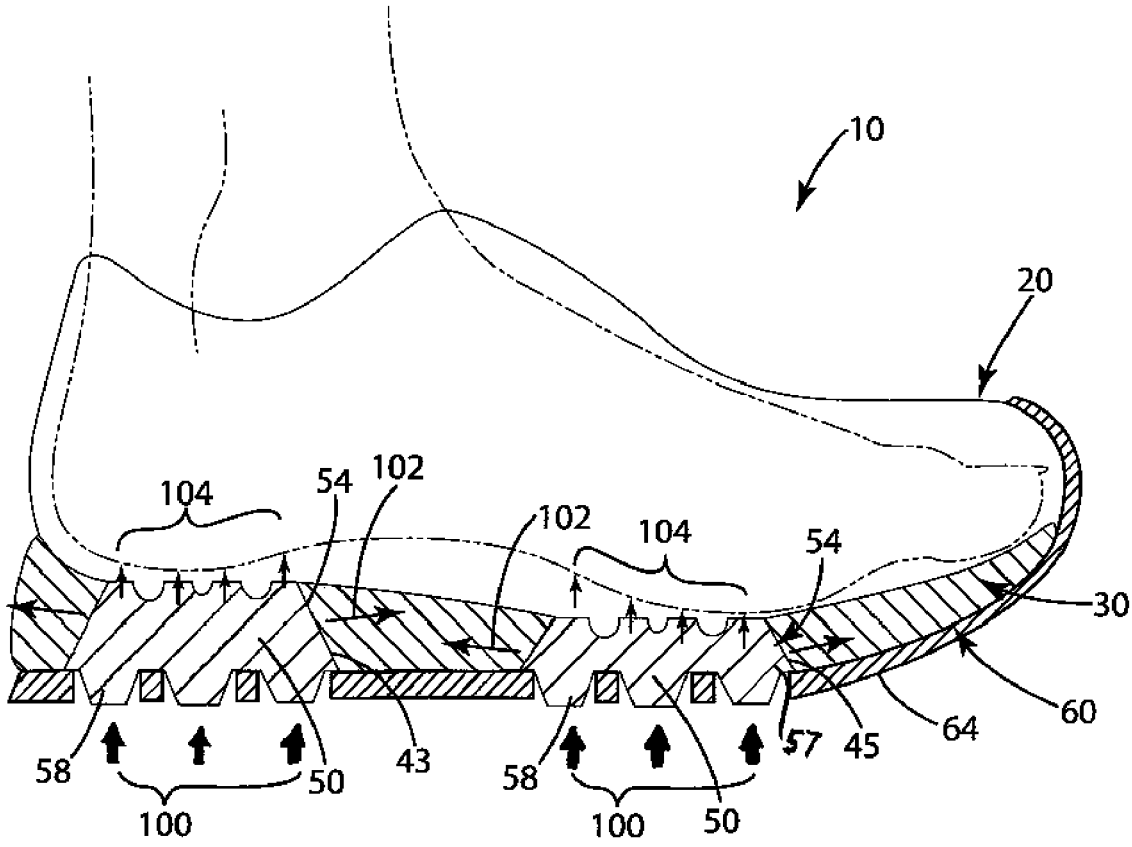
FIG. 6 is a sectional view of the footwear taken along line 6-6 of FIG. 1.

Referring to FIGS. 2, 3 and 6, the shock pods can be of any configuration, shape and/or cross section. As shown, they are generally configured the same shape as the midsole holes 40 so that the shock pods 40 nest within the holes. The shock pods can have an upwardly thinning tapered configuration that substantially corresponds with the downwardly opening tapered configuration of the midsole holes 40. In the embodiment shown, the shock pods 56 and 53 each include an upwardly thinning, frustoconical shape extending from an upper portion 55 to a lower portion 57. The upper portion 55 can correspond with and be contiguous with the upper surface 34 of the midsole as desired. Optionally, the upper portion 55 can define grooves 51, which as shown, are concentric grooves. Other configurations of the grooves can be used as desired. The lower portion 57 of the shock pods 50 include one or more lugs 58. These lugs can be configured to align with and extend substantially through the outsole holes 68 to form a ground contacting surface.

The shock pods also can include optional indexing features, which as shown, are in the form of tabs 59. These tabs can be configured to lock within the indexing features 48 to hold the shock pods in a desired, aligned configuration. This aligned configuration can assist in alignment of the optional lugs 58 with outsole holes 68 when joining the outsole 60 to the midsole 30. Optionally, an alternative self-aligning, shock pod 50 shape and corresponding midsole hole 40 shape can be used for alignment purposes. For example, where the shock pods are oval or square, the shape of the pods would self align the shock pods 50 in the holes 40.

The shock pods 50 can include a side wall 54 which generally is of a frustoconical shape to match one embodiment of the midsole holes 40 as discussed above. However, the side wall 54 can be angled or curved in a variety of other configurations. In one configuration, it can be shaped so that the cross section of the shock pod 50 generally thins from the lower portion 57 to the upper portion 55. This side wall 54 also can include additional interlocking features to assist in joining the shock pods 50 with the midsole holes 40 and/or aligning these elements as desired.

The shock pods 50 can be constructed from polyurethane, such as a low-rebound polyurethane or ethylvinyl acetate having low rebound properties. In the embodiment shown, the shock pods are constructed from a material that is softer than the midsole 30, for example, polyurethane. Optionally, having a durometer of about 35 to about 60 Asker C. Alternatively, the shock pods 50 can be constructed from the same material as the midsole 30, however, the shock pod material can be of a lower density and/or include voids or other structures to give the shock pods an improved cushioning characteristic over the surrounding midsole.

Further, the shock pods 50 and the midsole 30 are shown as separate components—these components can be a unitary, integrally molded structure, where the shock pods are simply molded within the midsole 30. In this embodiment, the pods can be direct attached to the midsole. Alternatively, the midsole 30 can be molded around the shock pods 50.

As noted above, the one or more shock pods 50 can provide zoned cushioning of an impact during activity. The effect of distributing an impact force 100 caused by activity when a wearer is engaged in such activity as illustrated in FIG. 6. There, an impact force caused by the footwear impacting the ground is transferred to the outsole 60 of the footwear. The primary impact zones, however, are near the heel and the forefoot, particularly the ball of the foot. Thus, most of the impact force 100 transfers to the lugs 58 of the shock pods 50. Upon this transfer of the impact force 100 to the lugs 58, a portion of the force is diffused to the lower portion 57 of the shock pod by the lug translating relative to that lower portion 57. Next, by virtue of the mechanical interface between the shock pods 50 and the midsole holes 40, namely the upwardly thinning shock pods 50 with the downwardly opening midsole holes 40, a portion of the impact force 100, namely force 102, is transferred from the softer shock pods 50 to the midsole 30, very much like driving a wedge into a log to split the log. In effect, the resulting forces 104 transferred to the heel and the ball of the foot are only a portion of the initial impact forces 100, which reduces the overall shock and impact to the foot of the wearer.

II. Manufacture and Assembly

Manufacture of the footwear 10 will now be described with reference to FIGS. 2-3. The upper 20 is manufactured using generally conventional techniques and apparatus. In the illustrated embodiment, the bottom of the upper 20 is closed, for example, by a Stroble or other suitable construction.

In another step, the midsole 30 is formed. Material from which the midsole is made can be injected or pour molded into a mold shaped to correspond to the features of the midsole, for example, the upper surface 34, the lower surface 32, the support plate recess 39, the heel wall 37, the heel counter band recess 37 and the additional recesses 38. The mold can further be contoured so that the shock pod or the shock pod holes 42 and 44, along with any optional indexing features, are formed in the desired regions of the footwear. As desired, the midsole can also be formed without the midsole holes 40 and these holes 40 can be trimmed or drilled into the midsole after it is formed. Likewise, the other features can be trimmed into the midsole as desired.

In an another step, the shock pods 50 are formed by injecting or pour molding the shock pod's material into a mold shaped to correspond to the features of the shock pod, for example, the lugs 58, the side wall 54 and the like. In general, the shock pods can be molded in a shape so that they mechanically lock within the midsole holes 40. With the shock pod constructed, they are positioned within the respective midsole holes 42 and 44. Where indexing features 59 are included on the shock pods 50, those indexing features are aligned with the midsole indexing features 48. As the application requires, the shock pods 50 can be cemented in place if desired within the midsole holes 40. Alternatively, the shock pods 50 can be molded directly in the midsole 30, or the midsole 30 can be molded around the shock pods 50. Further alternatively, the midsole 30 and shock pods 50 can be co-molded in a common mold.

In yet another step, the heel counter band 80 can be molded. Once it is molded, it can be adhered with conventional adhesives into the heel band recess 37 in the heel wall 36, as well as the additional recesses 38 to provide a structurally supportive heel region 76 of the footwear.

The optional support plate 90 and shank 35 can be adhered to the midsole with conventional adhesives, or can be co-molded with the midsole material upon forming the midsole 30.

The outsole 60 can be injection molded or pour molded from a hard, durable material, such as rubber, using conventional molding apparatus and techniques. The tread pattern on the lower surface 64 of the outsole and the outsole holes 68 defined by the outsole can be formed during the molding operation. Optionally, these features, as well as any contours or shapes of the outsole components, can be cut through or in the outsole 60 after the outsole is formed. It is noted that the holes 68 can be cut so that they align with the lugs 58 of the shock pods and/or a portion of the support plate 90 that extends through corresponding holes in the outsole 60. The outsole and its components can be secured to the midsole with cement, adhesives or other attachment devices. The outsole components can be trimmed as desired to ensure a clean and flush fit with the upper and/or midsole as well.

In another step, the upper 20 is joined with the midsole 30 and/or outsole 60. This can be accomplished by adhering these components together. With the midsole 30 and outsole 60 joined with the upper 20, the footbed 24 can be positioned in the interior of the upper 20. A number of conventional finishing operations can be performed on the footwear 10. For example, the edges of the midsole 30 and outsole 60 can be trimmed and shaped; the upper 20 can be cleaned of any excessive adhesive, polished and treated as appropriate, and where applicable, laces can be inserted into eyelets.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A footwear construction comprising:

a midsole including an upper surface, a lower surface, and defining at least one shock pod hole that reduces in dimension as the hole extends from the lower surface toward the upper surface;

a shock pod joined with the midsole so that the shock pod extends from at least the lower surface toward the upper surface of the midsole, wherein the shock pod includes a plurality of lugs protruding from the lower portion;

an outsole joined with the midsole so that a lower portion of the shock pod extends through the outsole to form a ground contacting surface, wherein the outsole defines a plurality of outsole holes, wherein the lugs extend independently through corresponding holes in the outsole; and an upper joined with the midsole.

2. The footwear construction of claim 1 wherein the shock pod is constructed from a first material that is softer than a second material from which the midsole is formed.

3. The footwear construction of claim 2 wherein the shock pod includes an upper portion distal from the lower portion, wherein the shock pod is frustoconical and reduces in cross section from the lower portion toward the upper portion.

4. The footwear construction of claim 3 wherein the shock pod hole extends through the midsole from the lower surface to the upper surface, wherein the hole is frustoconical, and reduces in cross section from the lower surface to the upper surface.

5. The footwear construction of claim 4 wherein the lugs protruding from the lower portion are spaced from one another.

6. The footwear construction of claim 5 wherein each of the outsole holes corresponds to one of the plurality of lugs, wherein each of the lugs extends through one of the outsole holes.

7. A footwear construction comprising;

a midsole including an upper surface and a lower surface, the midsole defining a first hole in a heel region, and a second hole in a forefoot region, the first and second holes each extending from the upper surface to the lower surface, the first and second holes each having a downwardly opening frustoconical shape, the midsole constructed from a first material;

a first shock pod disposed in the first hole and a second shock pod disposed in the second hole, the first and second shock pods each having an upwardly thinning frustoconical shape that substantially corresponds with the downwardly opening frustoconical shape of the first and second holes, the first and second shock pods each including a lower surface including a lug, the first and second shock pods constructed from a second material that is softer than the first material of the midsole;

an upper joined with the midsole;

an outsole joined with the midsole, the outsole defining a lug hole, the lug extending through the lug hole to form a ground contacting surface, whereby the shock pods transfer a portion of an impact force, which is generated by a wearer's foot within the footwear impacting the ground, to the midsole thereby reducing the total impact force transferred to the wearer and providing a cushioning effect.

8. The footwear construction of claim 7 wherein the first and second shock pods are cemented in the respective first and second holes.

9. The footwear construction of claim 7 wherein the first and second shock pods form a unitary, integral structure with the midsole in the respective first and second holes.

10. The footwear construction of claim 7 wherein the first and second shock pods are nested, but freely floating, within the respective first and second holes, wherein the first shock pod includes an upper portion that is free from attachment to an upper portion of the second shock pod.

11. A footwear construction comprising:

a midsole including an upper surface and a lower surface, the midsole defining a first hole in a heel region, and a second hole in a forefoot region, the first and second holes each extending from the upper surface to the lower surface, the first and second holes each having a downwardly opening frustoconical shape, the midsole constructed from a first material;

a first shock pod disposed in the first hole and a second shock pod disposed in the second hole, the first and second shock pods each having an upwardly thinning frustoconical shape that substantially corresponds with the downwardly opening frustoconical shape of the first and second holes, the first and second shock pods each including a lower surface including a lug, the first and second shock pods constructed from a second material that is softer than the first material of the midsole;

an upper joined with the midsole;

an outsole joined with the midsole, the outsole defining a lug hole, the lug extending through the lug hole to form a ground contacting surface, whereby the shock pods transfer a portion of an impact force, which is generated by a wearer's foot within the footwear impacting the ground, to the midsole thereby reducing the total impact force transferred to the wearer and providing a cushioning effect; and a heel counter band, wherein the midsole includes an upwardly standing heel wall, wherein the heel counter band is joined with the midsole in an arch region on opposite sides of the midsole, and further joined with the upwardly standing heel wall, whereby the heel band cooperates with the midsole to center the heel of a wearer over the first shock pod and guide the impact of the heel upon that first shock pod.

12. The footwear construction of claim 7 wherein the first material has a durometer of about 45 to about 65, and wherein the second material has a durometer of about 35 to about 60 Asker C.

13. A footwear construction comprising:

an upper;

a sole component joined with the upper, the sole component defining a first hole in at least one of a heel region and forefoot region, the first hole extending substantially through the sole component, the first hole having a downwardly opening, tapered configuration, the sole component constructed from a first material;

a first shock pod disposed in the first hole, the first shock pod having an upwardly thinning, tapered configuration that substantially corresponds with the downwardly opening, tapered configuration of the first hole, the first shock pod including a lug, the first shock pod constructed from a second material that is softer than the first material of the midsole;

an outsole joined with the sole component, the outsole defining a lug hole, the lug of the first shock pod extending through the lug hole to form a ground contacting surface, whereby the first shock pod distributes impact forces from the ground to the sole component when a foot of the wearer of the footwear impacts the ground.

14. The footwear construction of claim 13 wherein the first hole is of a frustoconical configuration and the first shock pod is of a corresponding frustoconical configuration so that the shock pod nests within the first hole.

15. The footwear construction of claim 13 wherein the first shock pod forms a unitary, integral structure with the sole component within the first hole.

16. The footwear construction of claim 13 wherein the first hole is defined in the heel, and a second hole is defined in the forefoot, immediately under the location where a ball of a wearer's foot is located within the footwear, wherein a second shock pod is nested within the second hole.

17. The footwear construction of claim 16 wherein the first hole and the second hole are each of frustoconical configurations, wherein the first shock pod and the second shock pod are of corresponding frustoconical configurations so that the first and second shock pods interfit the first and second holes respectively.

* * * * *